US010809662B2

(12) United States Patent
Amann et al.

(10) Patent No.: US 10,809,662 B2
(45) Date of Patent: Oct. 20, 2020

(54) TONER CARTRIDGE HAVING POSITIONING FEATURES

(71) Applicant: LEXMARK INTERNATIONAL, INC., Lexington, KY (US)

(72) Inventors: Mark William Amann, Lexington, KY (US); Brian Lester Boettcher, Versailles, KY (US); David Lee Merrifield, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/874,923

(22) Filed: May 15, 2020

(65) Prior Publication Data

US 2020/0278639 A1 Sep. 3, 2020

Related U.S. Application Data

(63) Continuation of application No. 16/243,388, filed on Jan. 9, 2019, now Pat. No. 10,656,592.

(51) Int. Cl.
*G03G 21/00* (2006.01)
*G03G 21/18* (2006.01)

(52) U.S. Cl.
CPC ..... *G03G 21/1842* (2013.01); *G03G 21/1853* (2013.01); *G03G 2221/183* (2013.01)

(58) Field of Classification Search
CPC ..... G03G 21/1676; G03G 21/1842; G03G 21/1853; G03G 2221/163; G03G 2221/1654; G03G 2221/1884; G03G 2221/183
USPC ..... 399/111, 119
See application file for complete search history.

(56) References Cited

U.S. PATENT DOCUMENTS

| | | | |
|---|---|---|---|
| 5,943,529 A | 8/1999 | Miyabe et al. | |
| 6,351,620 B1 | 2/2002 | Miyabe et al. | |
| 9,772,600 B2 * | 9/2017 | Morioka | G03G 21/1803 |
| 2003/0156848 A1 | 8/2003 | Kawai et al. | |

(Continued)

FOREIGN PATENT DOCUMENTS

| | | |
|---|---|---|
| JP | 08016070 A * | 1/1996 |
| JP | 08314216 A * | 11/1996 |

(Continued)

OTHER PUBLICATIONS

Extended European Search Report dated Jun. 2, 2020 for European Patent Application No. 19219586.5.

*Primary Examiner* — Robert B Beatty

(57) ABSTRACT

A toner cartridge according to one example embodiment includes a first positioning slot positioned on a first side of a housing of the toner cartridge for receiving a first corresponding positioning rib in an image forming device for defining an axial position of a photoconductive drum relative to the image forming device when the toner cartridge is installed in the image forming device. A second positioning slot is positioned on a second side of the housing for receiving a second corresponding positioning rib in the image forming device for defining an axial position of a developer roll relative to the image forming device when the toner cartridge is installed in the image forming device. The first and second positioning slots extend upward from a bottom of the housing near a longitudinal end of the housing.

14 Claims, 13 Drawing Sheets

(56) References Cited

U.S. PATENT DOCUMENTS

| | | | | |
|---|---|---|---|---|
| 2003/0215261 | A1* | 11/2003 | Karakama | G03G 21/1871 399/111 |
| 2007/0071496 | A1* | 3/2007 | Lee | G03G 21/1853 399/111 |
| 2010/0239310 | A1* | 9/2010 | Matsumoto | G03G 21/1842 399/111 |
| 2014/0241736 | A1* | 8/2014 | Shinoya | G03G 21/1832 399/12 |
| 2014/0241758 | A1* | 8/2014 | Rulon | G03G 15/08 399/260 |
| 2018/0348694 | A1 | 12/2018 | Koyama et al. | |

FOREIGN PATENT DOCUMENTS

| | | | |
|---|---|---|---|
| JP | 2000181325 | A * | 6/2000 |
| JP | 2012068459 | A * | 4/2012 |

* cited by examiner

TONER CARTRIDGE HAVING POSITIONING FEATURES

CROSS REFERENCES TO RELATED APPLICATIONS

This application is a continuation application of U.S. patent application Ser. No. 16/243,388, filed Jan. 9, 2019, entitled "Toner Cartridge Having Positioning Features."

BACKGROUND

1. Field of the Disclosure

The present disclosure relates generally to image forming devices and more particularly to a toner cartridge having positioning features.

DESCRIPTION OF THE RELATED ART

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable toner cartridges that have a shorter lifespan than the image forming device. It is important that the toner cartridge(s) are precisely aligned within the image forming device. If a toner cartridge is misaligned, one or more input gears on the toner cartridge may fail to maintain proper gear mesh with corresponding output gears in the image forming device and one or more electrical contacts on the toner cartridge may fail to maintain an electrical connection with corresponding electrical contacts in the image forming device. Further, if a toner cartridge is misaligned, various imaging components of the toner cartridge (such as a photoconductive drum) may be incorrectly positioned relative to the image forming device potentially resulting in toner leakage or print quality defects. The requirement for tight positional control must be balanced with the need to permit a user to easily load and unload the toner cartridge(s) into and out of the image forming device. Accordingly, it will be appreciated that precise alignment of the toner cartridge(s) and relatively simple insertion and removal of the toner cartridge(s) into and out of the image forming device is desired. It is also desired to limit the overall size of the toner cartridge(s) in order to meet customer demand for compact image forming devices.

SUMMARY

A toner cartridge according to one example embodiment includes a housing having a top, a bottom, a first side and a second side positioned between a first longitudinal end and a second longitudinal end of the housing. The housing has a reservoir for holding toner, A photoconductive drum is rotatably positioned on the housing. A portion of an outer surface of the photoconductive drum is positioned along the bottom of the housing. The photoconductive drum includes a first rotational axis. A developer roll is rotatably positioned on the housing and positioned to supply toner from the reservoir to the photoconductive drum. A first drive coupler and a second drive coupler are positioned on the first longitudinal end of the housing for mating with a first corresponding drive coupler in an image forming device and a second corresponding drive coupler in the image forming device for receiving rotational motion from the first corresponding drive coupler in the image forming device and the second corresponding drive coupler in the image forming device when the toner cartridge is installed in the image forming device. The first drive coupler of the toner cartridge is operatively connected to the photoconductive drum to transfer rotational motion to the photoconductive drum and the second drive coupler of the toner cartridge is operatively connected to the developer roll to transfer rotational motion to the developer roll. A first positioning slot is positioned on the first side of the housing for receiving a first corresponding positioning rib in the image forming device for defining an axial position of the photoconductive drum relative to the image forming device along the first rotational axis when the toner cartridge is installed in the image forming device. The first positioning slot extends upward from the bottom of the housing near the second longitudinal end of the housing. A second positioning slot is positioned on the second side of the housing for receiving a second corresponding positioning rib in the image forming device for defining an axial position of the developer roll relative to the image forming device along the second rotational axis when the toner cartridge is installed in the image forming device. The second positioning slot extends upward from the bottom of the housing near the second longitudinal end of the housing.

In some embodiments, the first positioning slot overlaps with the second positioning slot along a longitudinal dimension of the housing that runs from the first longitudinal end to the second longitudinal end.

Embodiment include those wherein the first positioning slot is formed between a first upward extending wall and a second upward extending wall and the second positioning slot is formed between a third upward extending wall and a fourth upward extending wall. The first and third upward extending walls face away from the first longitudinal end of the housing and toward the second longitudinal end of the housing and the second and fourth upward extending walls face away from the second longitudinal end of the housing and toward the first longitudinal end of the housing.

In some embodiments, the first positioning slot and the second positioning slot each include an open bottom end that permits the respective first and second corresponding positioning ribs in the image forming device to enter the first and second positioning slots from below when the toner cartridge is installed in the image forming device.

Embodiments include those wherein the first positioning slot is recessed into an exterior of the first side of the housing and the second positioning slot is recessed into an exterior of the second side of the housing.

Some embodiments include a toner adder roll rotatably positioned on the housing to supply toner from the reservoir to the developer roll. The toner adder roll includes a roll body cylindrically disposed around a shaft. The roll body extends along an inner surface of the bottom of the housing and an inner surface of the second side of the housing. An axial end of the roll body is positioned adjacent to an inner surface of an end wall of the reservoir that is proximate the second longitudinal end of the housing. The shaft extends through an opening in the end wall of the reservoir toward the second longitudinal end of the housing. A gear positioned on the shaft of the toner adder roll outboard of the end wall of the reservoir. The second positioning slot is positioned between the end wall of the reservoir and the gear along a longitudinal dimension of the housing that runs from the first longitudinal end to the second longitudinal end. In some embodiments, the second positioning slot and the roll body of the toner adder roll are positioned immediately adjacent to and on opposite sides of the end wall of the reservoir from each other.

Some embodiments include a waste toner reservoir positioned to store residual toner removed from the outer surface of the photoconductive drum. The first positioning slot is positioned at an intersection of the first side of the housing and an end wall of the waste toner reservoir that is proximate to the second longitudinal end of the housing.

A toner cartridge according to another example embodiment includes a housing having a top, a bottom, a first side and a second side positioned between a first longitudinal end and a second longitudinal end of the housing. The housing has a reservoir for holding toner, A longitudinal dimension of the housing runs from the first longitudinal end to the second longitudinal end. A photoconductor unit is positioned along the first side of the housing and has a rotatable photoconductive drum. A portion of an outer surface of the photoconductive drum is positioned along the bottom of the housing. A developer unit is positioned along the second side of the housing and has a rotatable developer roll. The developer roll is positioned to supply toner from the reservoir to the photoconductive drum. A first drive coupler and a second drive coupler are positioned on the first longitudinal end of the housing for mating with a first corresponding drive coupler in an image forming device and a second corresponding drive coupler in the image forming device for receiving rotational motion from the first corresponding drive coupler in the image forming device and the second corresponding drive coupler in the image forming device when the toner cartridge is installed in the image forming device. The first drive coupler of the toner cartridge is operatively connected to the photoconductive drum to transfer rotational motion to the photoconductive drum and the second drive coupler of the toner cartridge is operatively connected to the developer roll to transfer rotational motion to the developer roll. A first positioning slot positioned on the first side of the housing is configured to receive a first corresponding positioning rib in the image forming device for defining a position of the photoconductor unit relative to the image forming device along the longitudinal dimension of the housing when the toner cartridge is installed in the image forming device. The first positioning slot extends upward from the bottom of the housing near the second longitudinal end of the housing. A second positioning slot on the second side of the housing is configured to receive a second corresponding positioning rib in the image forming device for defining a position of the developer unit relative to the image forming device along the longitudinal dimension of the housing when the toner cartridge is installed in the image forming device. The second positioning slot extends upward from the bottom of the housing near the second longitudinal end of the housing. The first positioning slot overlaps with the second positioning slot along the longitudinal dimension of the housing.

A toner cartridge according to another example embodiment includes a housing having a top, a bottom, a first side and a second side positioned between a first longitudinal end and a second longitudinal end of the housing. The housing has a reservoir for holding toner. A longitudinal dimension of the housing runs from the first longitudinal end to the second longitudinal end. A developer roll is rotatably positioned on the housing for supplying toner to a photoconductive drum. A toner adder roll is rotatably positioned on the housing to supply toner from the reservoir to the developer roll. The toner adder roll includes a roll body cylindrically disposed around a shaft. The roll body extends along an inner surface of the bottom of the housing and an inner surface of the first side of the housing. An axial end of the roll body is positioned adjacent to an inner surface of an end wall of the reservoir that is proximate the first longitudinal end of the housing. The shaft extends through an opening in the end wall of the reservoir toward the first longitudinal end of the housing. A gear is positioned on the shaft of the toner adder roll outboard of the end wall of the reservoir. A first positioning wall is exposed on the first side of the housing to contact a corresponding positioning rib in the image forming device for defining a position of at least a portion of the toner cartridge relative to the image forming device along the longitudinal dimension of the housing when the toner cartridge is installed in the image forming device. The first positioning wall extends upward from the bottom of the housing. The first positioning wall faces away from the second longitudinal end of the housing and toward the first longitudinal end of the housing. The first positioning wall is positioned between the end wall of the reservoir and the gear along the longitudinal dimension of the housing.

In some embodiments, the first positioning wall and the roll body of the toner adder roll are positioned immediately adjacent to and on opposite sides of the end wall of the reservoir from each other.

Embodiments include those wherein the first positioning wall is formed by an outer surface of the end wall of the reservoir.

Some embodiments include a bearing on the housing that rotatably receives the shaft of the toner adder roll. The bearing is positioned outboard of the end wall of the reservoir and inboard of the gear. The first positioning wall is positioned between the end wall of the reservoir and the bearing along the longitudinal dimension of the housing.

Some embodiments include a second positioning wall exposed on the first side of the housing to contact the corresponding positioning rib in the image forming device when the toner cartridge is installed in the image forming device. The second positioning wall extends upward from the bottom of the housing. The second positioning wall faces away from the first longitudinal end of the housing and toward the second longitudinal end of the housing and faces toward the first positioning wall such that an upward extending positioning slot is formed between the first positioning wall and the second positioning wall.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
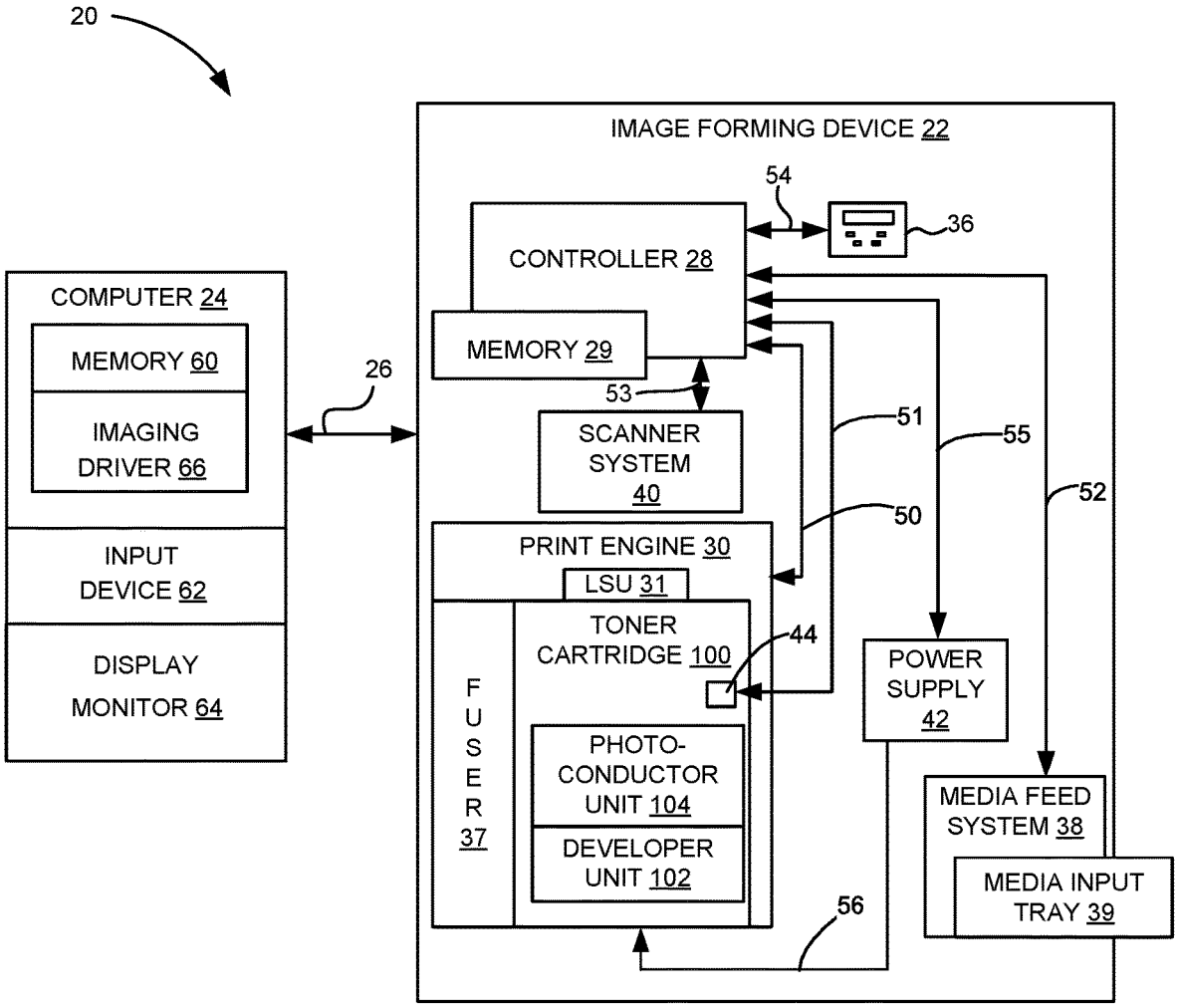
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx, Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with media feed system 38 via a communications link 52. Controller 28 communicates with scanner system 40 via a communications link 53. User interface 36 is communicatively coupled to controller 28 via a communications link 54. Controller 28 communicates with power supply 42 via a communications link 55. Controller 28 processes print and scan data and operates print engine 30 during printing and scanner system 40 during scanning. Processing circuitry 44 may provide authentication functions, safety and operational intedocks, operating parameters and usage information related to toner cartridge 100. Processing circuitry 44 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100 and a fuser 37, all mounted within image forming device 22. Toner cartridge 100 is removably mounted in image forming device 22. Power supply 42 provides an electrical voltage to various components of toner cartridge 100 via an electrical path 56. Toner cartridge 100 includes a developer unit 102 that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. In another embodiment, the toner development system utilizes what is commonly referred to as a dual component development system. In this embodiment, toner in the toner reservoir of developer unit 102 is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, developer unit 102 includes a developer roll that attracts the magnetic carrier beads having toner thereon to the developer roll through the use of magnetic fields. Toner cartridge 100 also includes a photoconductor unit 104 that houses a charge roll, a photoconductive drum and a waste toner removal system. Although the example image forming device 22 illustrated in FIG. 1 includes one toner cartridge, in the case of an image forming device configured to print in color, separate toner cartridges may be used for each toner color. For example, in one embodiment, the image forming device includes four toner cartridges, each toner cartridge containing a particular toner color (e.g., black, cyan, yellow and magenta) to permit color printing.

Figure 2:
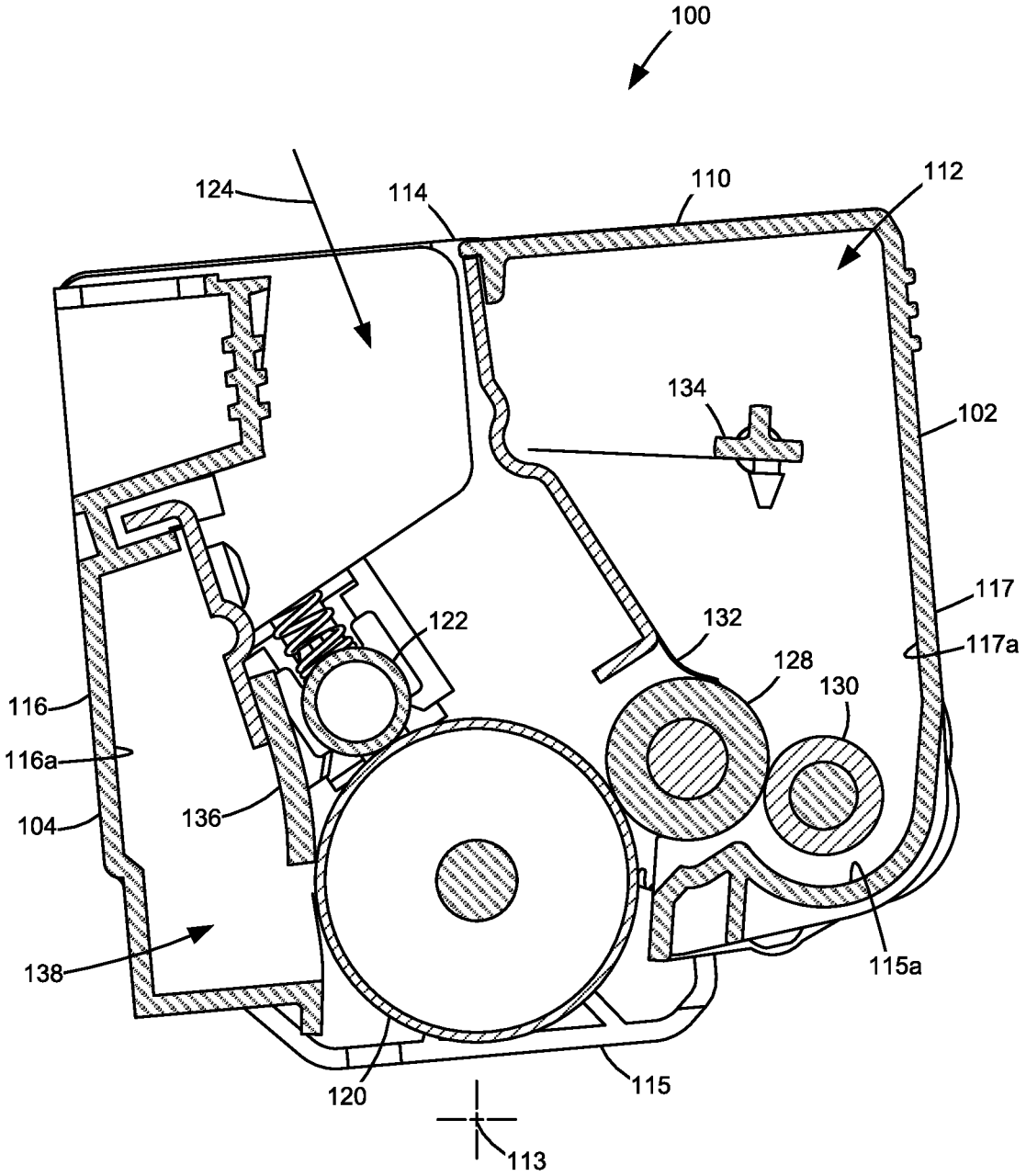
FIG. 2 is a cross-sectional view of a toner cartridge of the imaging system according to one example embodiment.

FIG. 2 shows toner cartridge 100 according to one example embodiment. Toner cartridge 100 includes an elongated housing 110 that includes walls forming a toner reservoir 112. In the example embodiment illustrated, housing 110 extends along a longitudinal dimension 113 and includes a top 114, a bottom 115, a side 116 and a side 117 that extend between longitudinal ends 118, 119 (FIGS. 3 and 4) of housing 110. In this embodiment, developer unit 102 is positioned along side 117 of housing 110 and photoconductor unit 104 is positioned along side 116 of housing 110.

The electrophotographic printing process is well known in the art and, therefore, is described briefly herein. During a print operation, a rotatable charge roll 122 of photoconductor unit 104 charges the surface of a rotatable photoconductive drum 120. The charged surface of photoconductive drum 120 is then selectively exposed to a laser light source 124 from LSU 31 through a slit 126 (FIG. 4) in the top 114 of housing 110 to form an electrostatic latent image on photoconductive drum 120 corresponding to the image to be printed. Charged toner from developer unit 102 is picked up by the latent image on photoconductive drum 120 creating a toned image on the surface of photoconductive drum 120. Charge roll 122 and photoconductive drum 120 are each electrically charged to a respective predetermined voltage by power supply 42 in order to achieve a desired voltage differential between the charged portions of the surface of photoconductive drum 120 and the portions of the surface of photoconductive drum 120 discharged by laser light source 124.

Developer unit 102 includes toner reservoir 112 having toner stored therein and a rotatable developer roll 128 that supplies toner from toner reservoir 112 to photoconductive drum 120. In the example embodiment illustrated, a rotatable toner adder roll 130 in developer unit 102 supplies toner from toner reservoir 112 to developer roll 128. A doctor blade 132 disposed along developer roll 128 provides a substantially uniform layer of toner on developer roll 128 for transfer to photoconductive drum 120. As developer roll 128 and photoconductive drum 120 rotate, toner particles are electrostatically transferred from developer roll 128 to the latent image on photoconductive drum 120 forming a toned image on the surface of photoconductive drum 120. In one embodiment, developer roll 128 and photoconductive drum 120 rotate in opposite rotational directions such that their adjacent surfaces move in the same direction to facilitate the transfer of toner from developer roll 128 to photoconductive drum 120. One or more movable toner agitators 134 may be provided in toner reservoir 112 to distribute the toner therein and to break up any clumped toner. Developer roll 128 and toner adder roll 130 are each electrically charged to a respective predetermined voltage by power supply 42 in order to attract toner from reservoir 112 to toner adder roll 130 and to electrostatically transfer toner from toner adder roll 130 to developer roll 128 and from developer roll 128 to the latent image on the surface of photoconductive drum 120. Doctor blade 132 may also be electrically charged to a predetermined voltage by power supply 42 as desired.

The toned image is then transferred from photoconductive drum 120 to the print media (e.g., paper) either directly by photoconductive drum 120 or indirectly by an intermediate transfer member. In the example embodiment illustrated, the surface of photoconductive drum 120 is exposed along the bottom 115 of housing 110 where the toned image transfers from photoconductive drum 120 to the print media or intermediate transfer member. Fuser 37 (FIG. 1) then fuses the toner to the print media. A cleaner blade 136 (or cleaner roll) of photoconductor unit 104 removes any residual toner adhering to photoconductive drum 120 after the toner is transferred from photoconductive drum 120 to the print media or intermediate transfer member.

Waste toner from cleaner blade 136 may be held in a waste toner reservoir 138 in photoconductor unit 104 as illustrated or moved to a separate waste toner container. The cleaned surface of photoconductive drum 120 is then ready to be charged again and exposed to laser light source 124 to continue the printing cycle.

Figure 3:
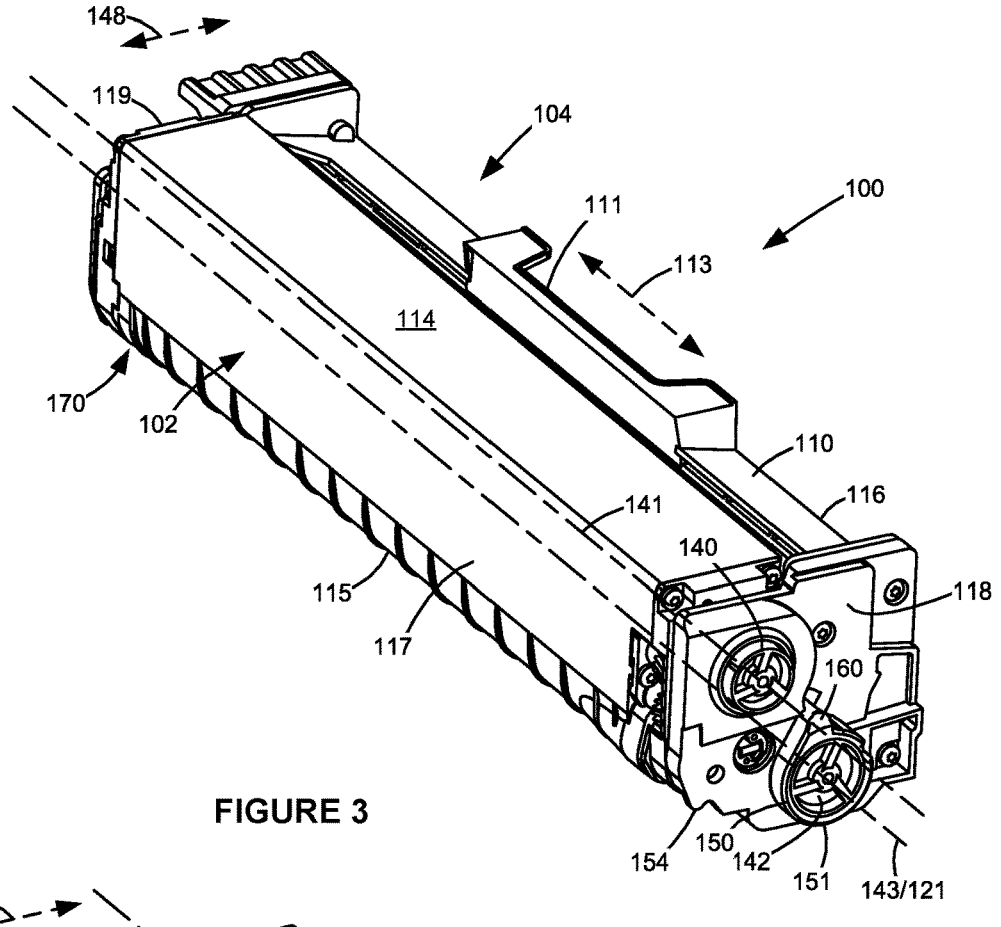
FIGS. 3 and 4 are perspective views of the toner cartridge according to one example embodiment.
Figure 4:
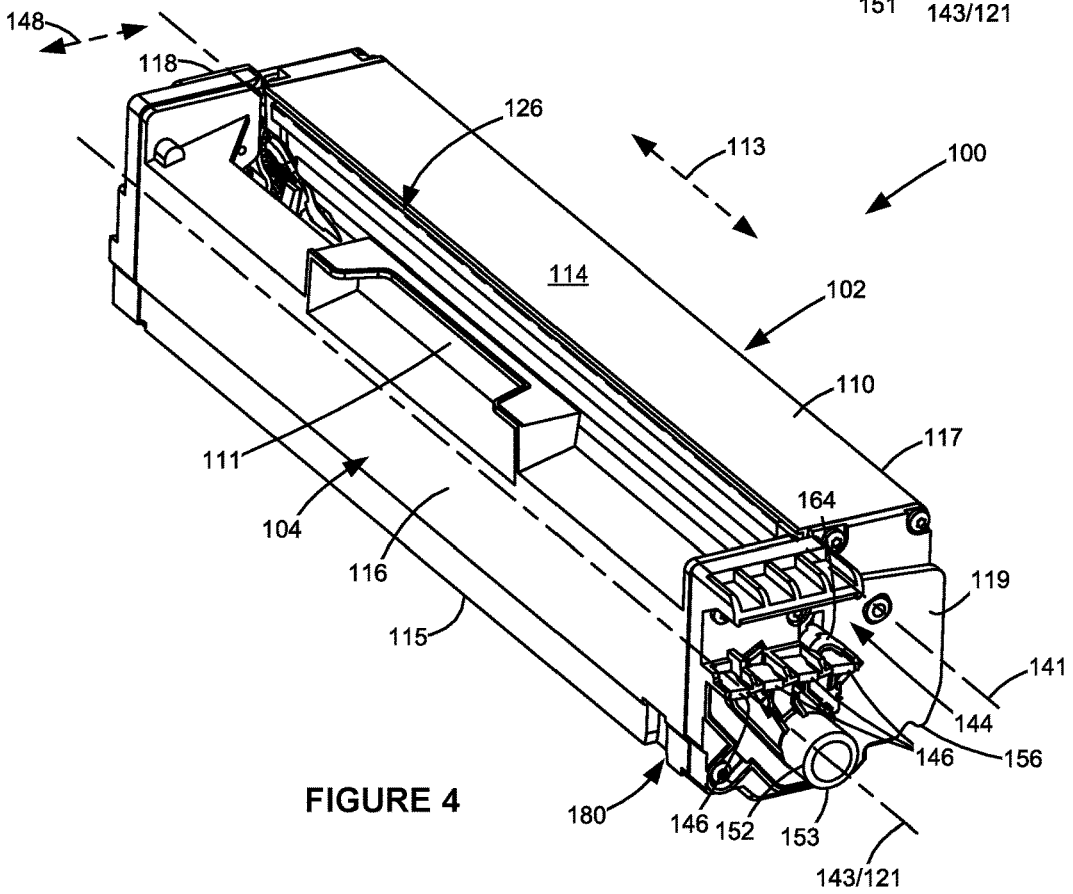
Figure 5:
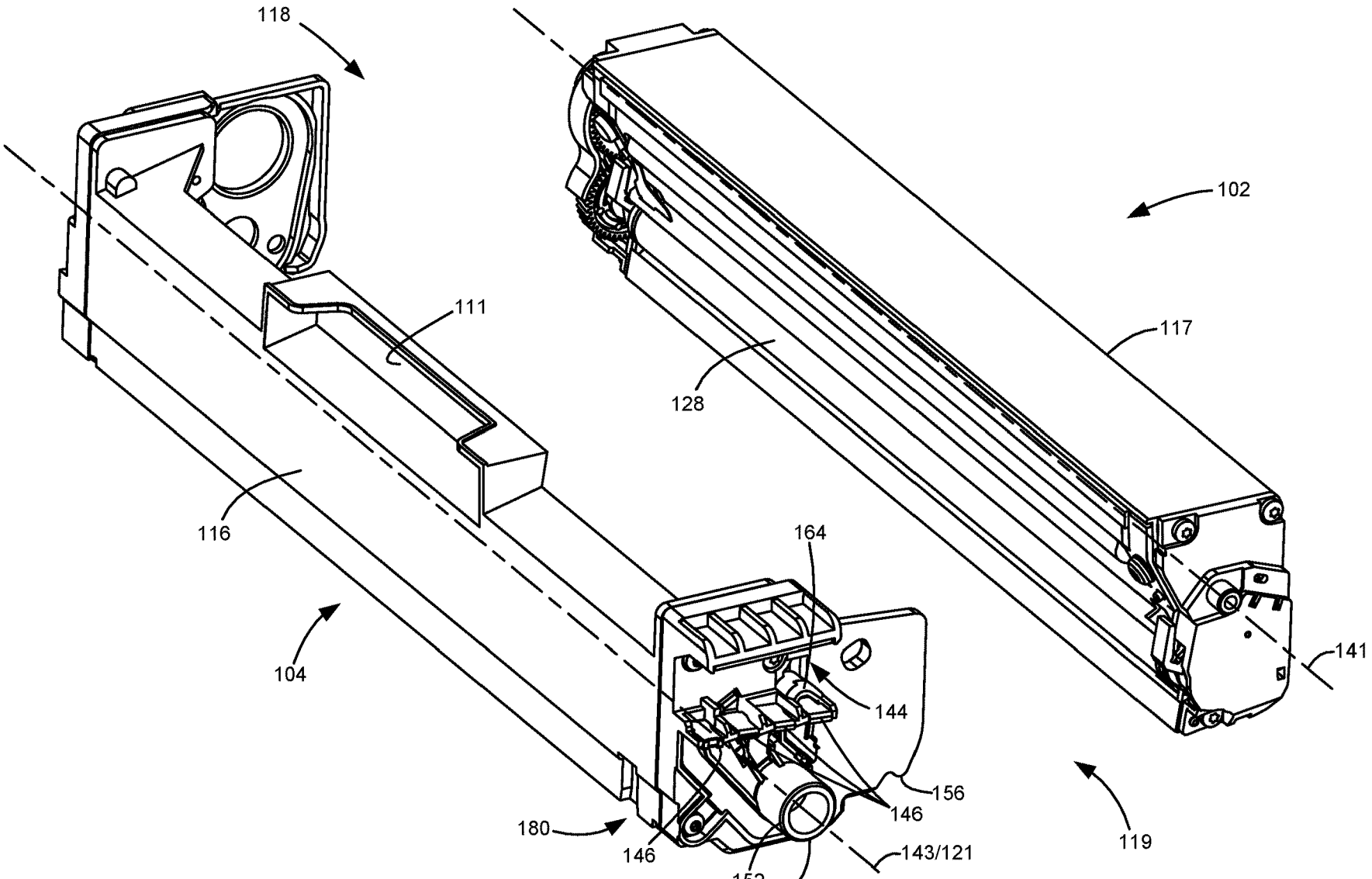
FIG. 5 is an exploded view of the toner cartridge shown in FIGS. 3 and 4 showing a developer unit and a photoconductor unit of the toner cartridge according to one example embodiment.

FIGS. 3-5 show the exterior of toner cartridge 100 according to one example embodiment. As shown, in this embodiment, developer unit 102 is positioned at side 117 of housing 110 and photoconductor unit 104 is positioned at side 116 of housing 110. FIG. 5 shows developer unit 102 separated from photoconductor unit 104 with developer roll 128 exposed on developer unit 102 for mating with photoconductive drum 120. In the example embodiment illustrated, toner cartridge 100 includes a handle 111 positioned along side 116 and/or top 114 of housing 110 to assist the user with handling toner cartridge 100.

Figure 6:
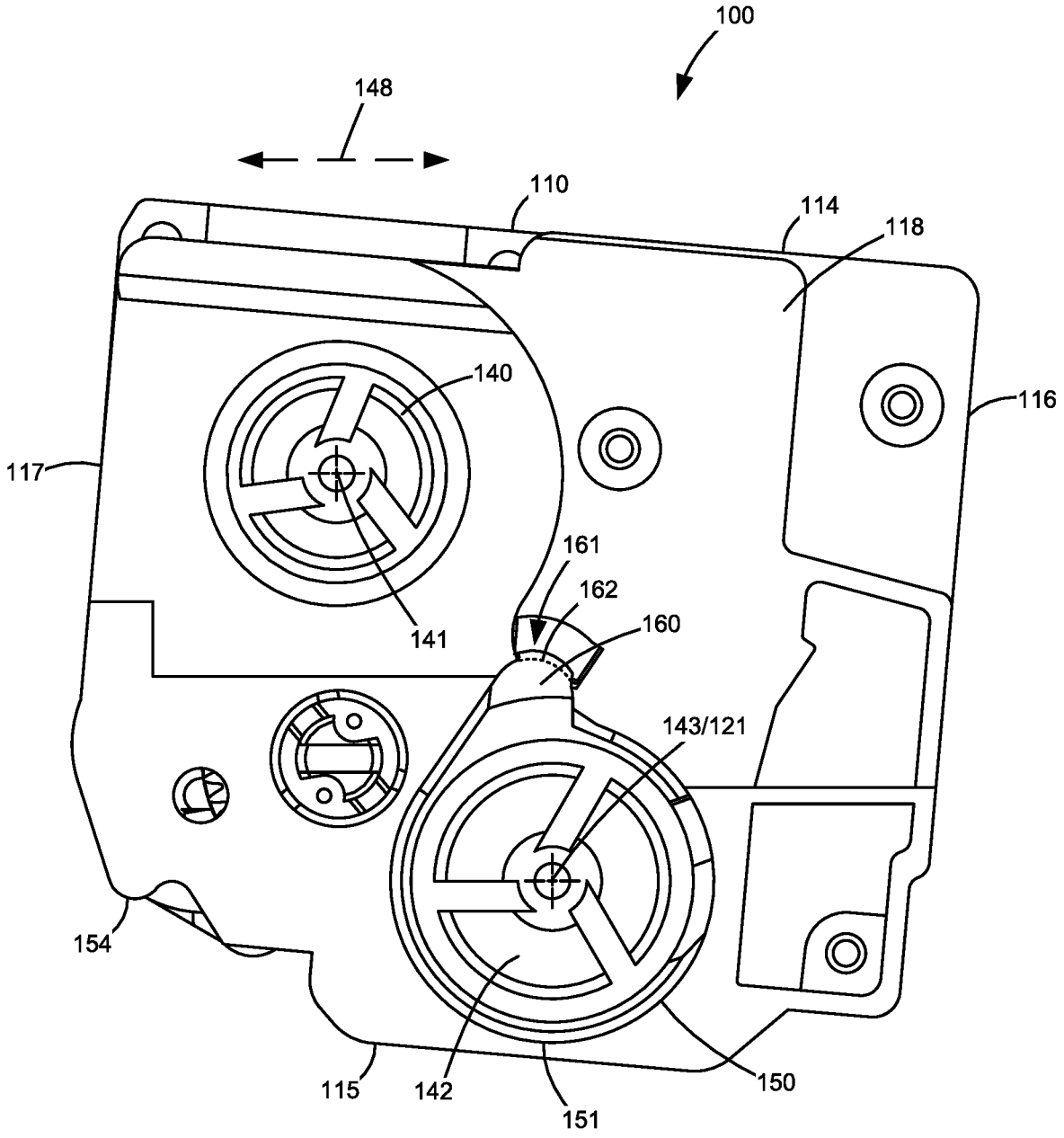
FIG. 6 is a first end elevation view of the toner cartridge of FIGS. 3-5 according to one example embodiment.

With reference to FIGS. 3 and 6, in the example embodiment illustrated, a pair of drive couplers 140, 142 are exposed on an outer portion of housing 110 in position to receive rotational force from a corresponding drive system in image forming device 22 when toner cartridge 100 is installed in image forming device 22 to drive rotatable components of developer unit 102 and photoconductive drum 120, respectively. The drive system in image forming device 22 includes one or more drive motors and a drive transmission from the drive motor(s) to a pair of drive couplers that mate with drive couplers 140, 142 of toner cartridge 100 when toner cartridge 100 is installed in image forming device 22. In the example embodiment illustrated, drive couplers 140, 142 are each exposed on end 118 of housing 110. Each drive coupler 140, 142 includes a rotational axis 141, 143. In the example embodiment illustrated, drive couplers 140, 142 are each configured to mate with and receive rotational motion from the corresponding drive couplers in image forming device 22 at the axial ends of drive couplers 140, 142. Drive coupler 140 is operatively connected (either directly or indirectly through one or more intermediate gears) to rotatable components of developer unit 102 including, for example, developer roll 128, toner adder roll 130 and toner agitator 134, to rotate developer roll 128, toner adder roll 130 and toner agitator 134 upon receiving rotational force from the corresponding drive system in image forming device 22. Drive coupler 142 is operatively connected (either directly as in the embodiment illustrated or indirectly through one or more intermediate gears) to photoconductive drum 120 to rotate photoconductive drum 120 upon receiving rotational force from the corresponding drive system in image forming device 22. In some embodiments, charge roll 122 is driven by friction contact between the surfaces of charge roll 122 and photoconductive drum 120. In other embodiments, charge roll 122 is connected to drive coupler 142 by one or more gears.

Figure 7:
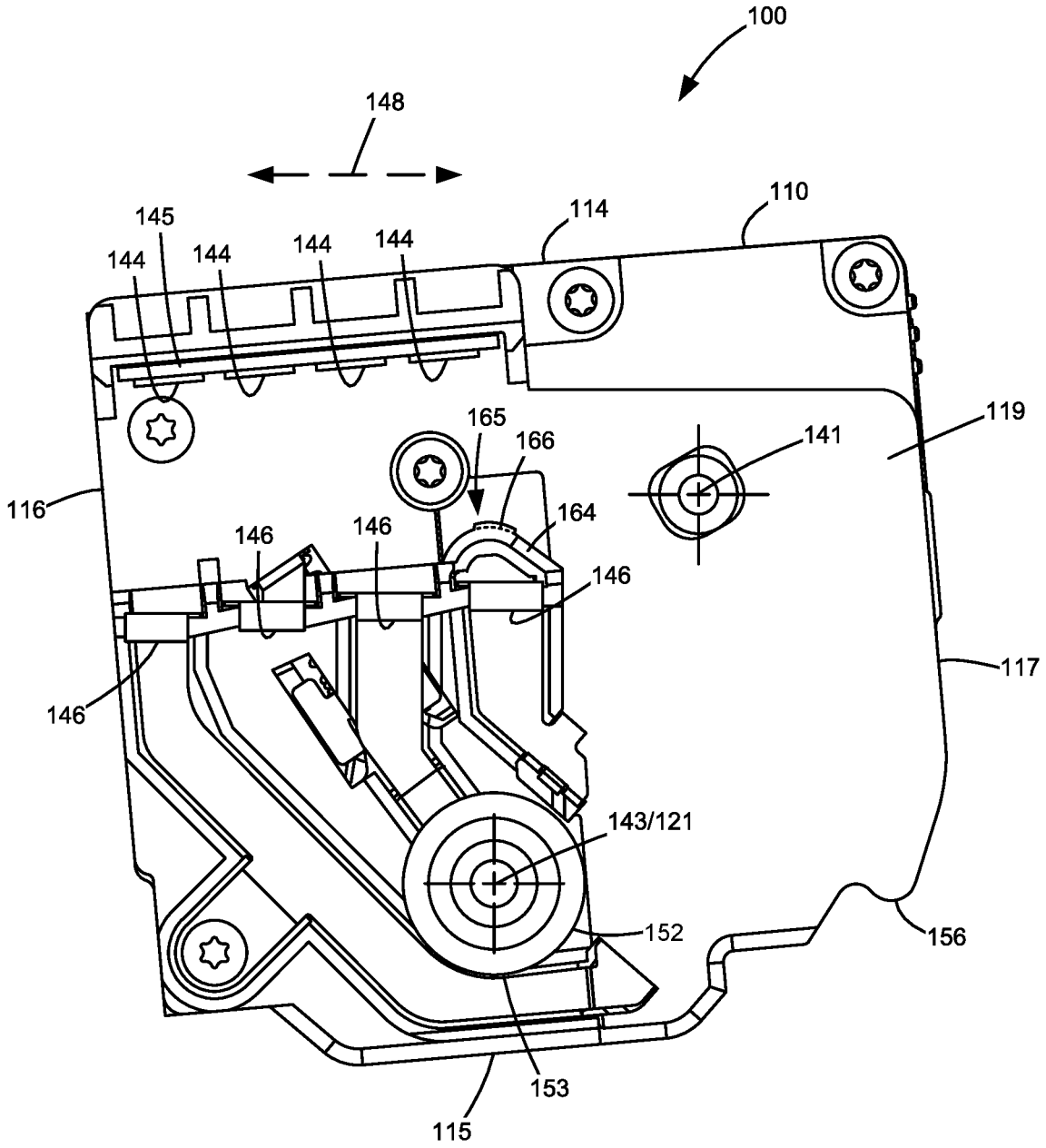
FIG. 7 is a second end elevation view of the toner cartridge of FIGS. 3-6 according to one example embodiment.

With reference to FIGS. 4 and 7, in the example embodiment illustrated, toner cartridge 100 includes one or more electrical contacts 144 positioned on end 119 of housing 110 and electrically connected to processing circuitry 44 and one or more electrical contacts 146 positioned on end 119 of housing 110 and electrically connected to one or more imaging components of toner cartridge 100. Electrical contacts 144 and 146 are positioned to contact corresponding electrical contacts in image forming device 22 when toner cartridge 100 is installed in image forming device 22 in order to facilitate communications link 51 between processing circuitry 44 and controller 28 and electrical path 56 between the one or more imaging components of toner cartridge 100 and power supply 42. In the example embodiment illustrated, electrical contacts 144 are positioned on a printed circuit board 145 that is mounted to housing 110 and that includes processing circuitry 44 thereon. In another embodiment, processing circuitry 44 is positioned elsewhere on housing 110 and is electrically connected to electrical contacts 144, for example, by suitable traces or cabling. In the example embodiment illustrated, electrical contacts 146 include discrete electrical contacts each electrically connected to one of photoconductive drum 120, charge roll 122, developer roll 128 and toner adder roll 130.

Electrical contacts 144 and 146 are unobstructed on end 119 of housing 110 permitting electrical contacts 144 and 146 to mate with corresponding electrical contacts in image forming device 22 upon installation of toner cartridge 100 into image forming device 22. In the example embodiment illustrated, electrical contacts 144 and 146 are each exposed and unobstructed from below (in a direction from bottom 115 to top 114 of housing 110) permitting the corresponding electrical contacts in image forming device 22 to contact electrical contacts 144 and 146 from below upon installation of toner cartridge 100 into image forming device 22. In the example embodiment illustrated, electrical contacts 144 are positioned higher than electrical contacts 146, such as directly above electrical contacts 146 as shown. In this embodiment, electrical contacts 144 and 146 extend outward, away from end 119, along an axial dimension of photoconductive drum 120. In the example embodiment illustrated, electrical contacts 144 are positioned adjacent to the top 114 of housing 110, higher than rotational axes 141, 143 of drive couplers 140, 142 and higher than rotational axis 121 of photoconductive drum 120. In this embodiment, electrical contacts 146 are positioned approximately midway up end 119 of housing 110, higher than rotational axis 143 of drive coupler 142 and higher than rotational axis 121 of photoconductive drum 120, but lower than rotational axis 141 of drive coupler 140. In the example embodiment illustrated, electrical contacts 144 and 146 are positioned adjacent to side 116 of housing 110. Electrical contacts 144 are aligned with electrical contacts 146 along a lateral dimension 148 of housing 110 that runs from side 116 to side 117, orthogonal to longitudinal dimension 113, such that electrical contacts 144 overlap with electrical contacts 146 along lateral dimension 148. Electrical contacts 144, 146 are spaced toward side 116 of housing 110 from rotational axis 141 of drive coupler 140, which is positioned closer to side 117 of housing 110 than to side 116 of housing 110 in the embodiment illustrated.

With reference to FIGS. 3-7, in the example embodiment illustrated, toner cartridge 100 includes a pair of positioning bosses 150, 152 that each protrude outward away from a respective end 118, 119 of housing 110 at and along a rotational axis 121 of photoconductive drum 120. Boss 150 is positioned on end 118 of housing 110 and at least partially encircles drive coupler 142. Boss 152 is positioned on end 119 of housing 110 at rotational axes 121 and 143 of photoconductive drum 120 and drive coupler 142. Each boss 150, 152 is unobstructed from below permitting the boss 150, 152 to contact and sit in a corresponding V-block in image forming device 22 in order to define a vertical position of toner cartridge 100 and a horizontal position of toner cartridge 100 along lateral dimension 148. In the example embodiment illustrated, a bottom portion of each boss 150, 152 includes a rounded bottom surface 151, 153, e.g., formed along an arc of a circle, that contacts and sits in the corresponding V-block in image forming device 22. In the embodiment illustrated, each boss 150, 152 is formed integrally with a respective end 118, 119 of housing 110.

In the example embodiment illustrated, toner cartridge 100 includes a pair of rotational stops 154, 156 that prevent rotation of toner cartridge 100 about an axis parallel to longitudinal dimension 113 of housing 110 when toner cartridge 100 is installed in image forming device 22. Each rotational stop 154, 156 is positioned along the bottom 115 of housing 110 at side 117 of housing 110 at a respective end 118, 119 of housing 110. In the embodiment illustrated, rotational stops 154, 156 are formed by members, such as extensions or feet, that protrude downward from the bottom 115 of housing 110 at ends 118, 119 of housing 110. Each rotational stop 154, 156 is unobstructed from below permitting each rotational stop 154, 156 to contact a corresponding portion of a frame in image forming device 22 in order to define a rotational position of toner cartridge 100. In the embodiment illustrated, each rotational stop 154, 156 is formed integrally with a respective end 118, 119 of housing 110 and corresponding boss 150, 152.

Toner cartridge 100 also includes a pair of hold-down engagement members 160, 164 that each contact a corresponding hold-down in image forming device 22 and receive a corresponding bias force to maintain contact between bosses 150, 152 of toner cartridge 100 and the corresponding V-blocks in image forming device 22 and between rotational stops 154, 156 of toner cartridge 100 and the corresponding portions of the frame in image forming device 22 during operation of toner cartridge 100 in image forming device 22. Each engagement member 160, 164 is unobstructed from above permitting the corresponding hold-downs in image forming device 22 to contact engagement members 160, 164 from above in order to apply a downward force on engagement members 160, 164, including, for example, a primarily downward force on engagement members 160, 164.

With reference to FIG. 6, engagement member 160 is positioned on end 118 of housing 110 higher than drive coupler 142, such as directly above drive coupler 142 as illustrated, and lower than drive coupler 140. Engagement member 160 overlaps with drive coupler 142 along lateral dimension 148 and is spaced toward side 116 of housing 110 from drive coupler 140. In the embodiment illustrated, engagement member 160 is positioned slightly toward side 117 of housing 110 relative to rotational axis 121 of photoconductive drum 120 and rotational axis 143 of drive coupler 142. In the embodiment illustrated, engagement member 160 includes a latch-receiving shelf 161 having a rounded contact surface 162 that faces upward permitting the corresponding hold-down in image forming device 22 to apply a downward force on engagement member 160. In other embodiments, engagement member 160 may include a flat, planar contact surface 162 that faces primarily upward. In the embodiment illustrated, engagement member 160 is formed by a rib that protrudes outward away from end 118 of housing 110. In this embodiment, engagement member 160 is formed integrally with boss 150 and end 118 of housing 110, In this embodiment, engagement member 160 and boss 150 combine to form a unitary member with engagement member 160 protruding upward from boss 150.

With reference to FIG. 7, engagement member 164 is positioned on end 119 of housing 110 higher than boss 152 and at least a portion of electrical contacts 146, such as directly above one of electrical contacts 146 as illustrated, and lower than electrical contacts 144, such as between electrical contacts 146 and electrical contacts 144. Engagement member 164 is positioned higher than rotational axis 121 of photoconductive drum and rotational axis 143 of drive coupler 142, but lower than rotational axis 141 of drive coupler 140. Engagement member 164 is also positioned higher than engagement member 160. Engagement member 164 overlaps with at least a portion of electrical contacts 144 and 146 and with boss 152 along lateral dimension 148. Engagement member 164 is spaced toward side 116 of housing 110 from rotational axis 141 of drive coupler 140. In the embodiment illustrated, engagement member 164 also overlaps with engagement member 160 along lateral dimension 148. In the embodiment illustrated, engagement member 164 includes a latch-receiving shelf 165 having a rounded contact surface 166 that faces upward permitting the corresponding hold-down in image forming device 22 to apply a downward force on engagement member 164. In other embodiments, engagement member 164 may include a flat, planar contact surface 166 that faces primarily upward. In the embodiment illustrated, engagement member 164 is formed by a rib that protrudes outward away from end 119 of housing 110. In this embodiment, engagement member 164 is formed integrally with end 119 of housing 110 including a portion of housing 110 that protrudes outward away from end 119 and that supports electrical contacts 146.

Figure 8:
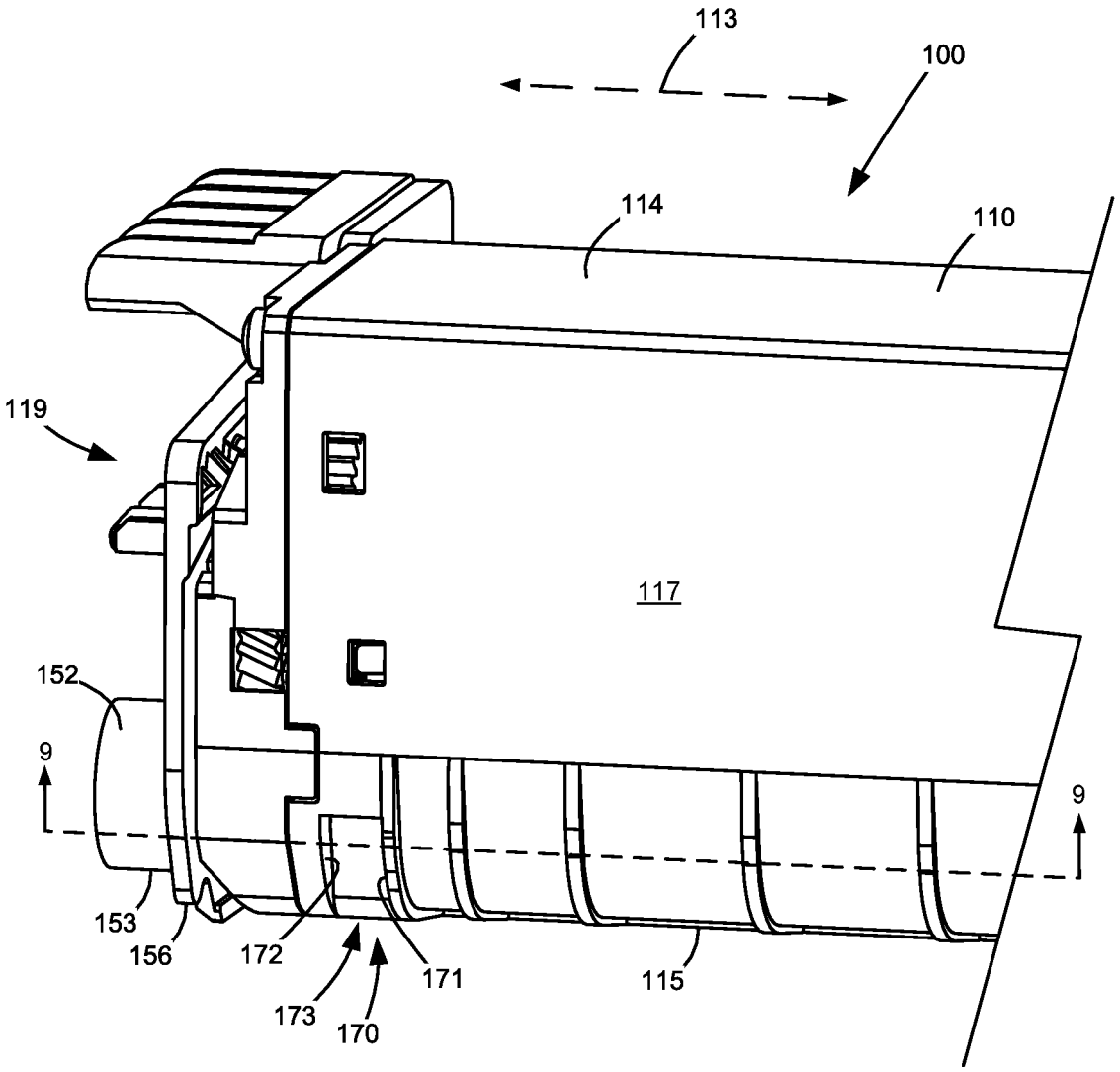
FIG. 8 is a perspective view of the toner cartridge showing a positioning slot on the photoconductor unit of the toner cartridge according to one example embodiment.

With reference to FIGS. 3 and 8, toner cartridge 100 includes a positioning slot 170 that receives a corresponding positioning rib in image forming device 22 to define a position of developer unit 102 along longitudinal dimension 113 of housing 110 (i.e., along axial dimensions of photoconductive drum 120, developer roll 128 and toner adder roll 130). Positioning slot 170 is positioned on side 117 of housing 110, near end 119 of housing 110. In the embodiment illustrated, positioning slot 170 extends upward (e.g., vertically upward) from bottom 115 of housing 110 at side 117. In this embodiment, positioning slot 170 is formed between a first wall 171 that faces away from end 118 and toward end 119 and a second wall 172 that faces away from end 119 and toward end 118. In some embodiments, walls 171 and 172 are parallel to each other, but, in other embodiments, they are not. In the embodiment illustrated, positioning slot 170 includes an open bottom end 173 that permits the corresponding positioning rib in image forming device 22 to enter positioning slot 170 between walls 171, 172 from below upon installation of toner cartridge 100 in image forming device 22 as discussed in greater detail below. In this embodiment, positioning slot 170 is recessed into side 117 of housing 110. The width of positioning slot 170 as measured from wall 171 to wall 172 may be constant or it may vary, e.g., positioning slot 170 may include a tapered lead-in at bottom end 173 causing the width of positioning slot 170 to narrow as positioning slot 170 extends upward from bottom end 173.

Figure 9:
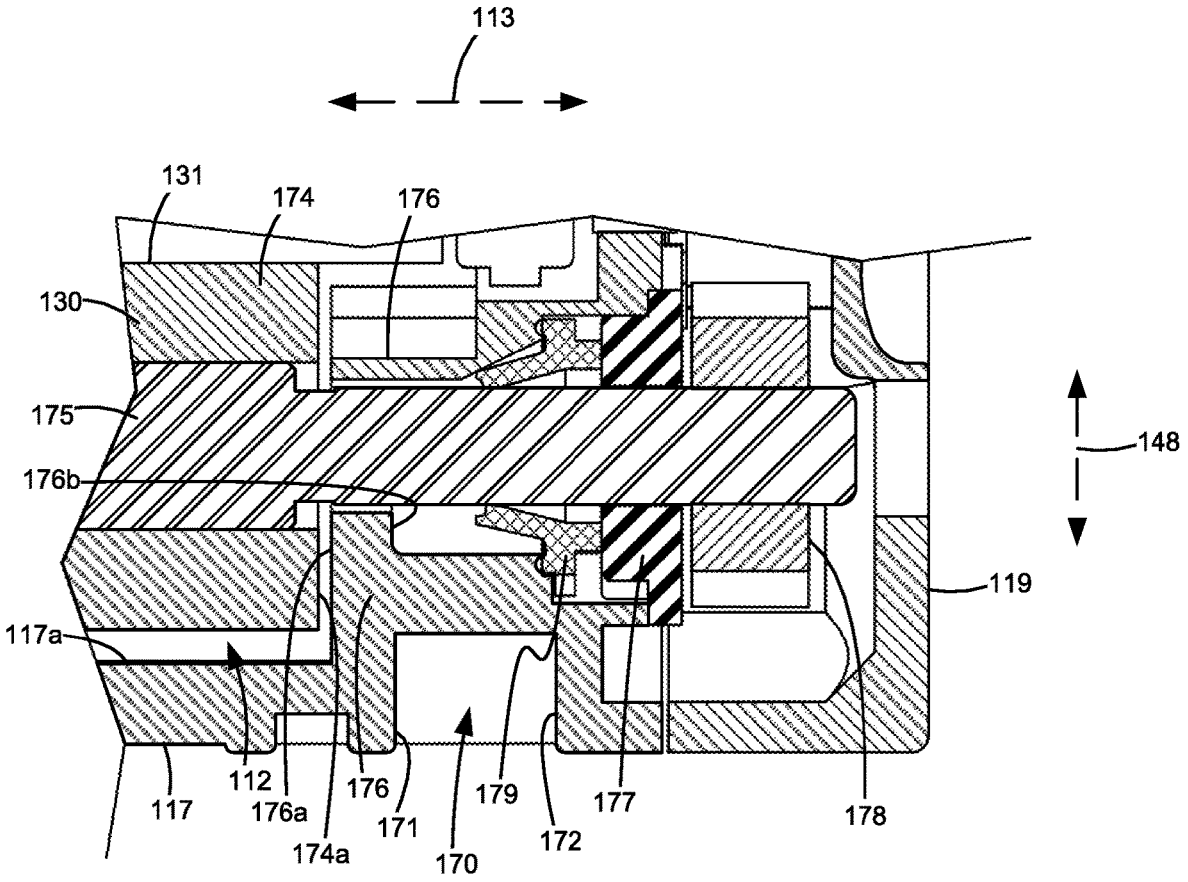
FIG. 9 is a cross-sectional view of the toner cartridge taken along line 9-9 in FIG. 8 showing the positioning slot on the photoconductor unit of the toner cartridge.

FIG. 9 is a cross-sectional view showing the position of positioning slot 170 on toner cartridge 100 relative to internal components of developer unit 102 in greater detail according to one example embodiment. In this embodiment, toner adder roll 130 extends along an inner surface 115*a* (FIG. 2) of bottom 115 of housing 110 and an inner surface 117*a* of side 117 of housing 110. Toner adder roll 130 includes an elastomeric roll body 174 (e.g., a flexible polymeric foam body) cylindrically disposed around a shaft 175. Roll body 174 forms an outer circumferential surface 131 of toner adder roll 130 that contacts and delivers toner to developer roll 128. The outer circumferential surface 131 of roll body 174 is positioned in close proximity to inner surface 115*a* of bottom 115 of housing 110 and inner surface 117*a* of side 117 of housing 110. An axial end surface 174*a* of roll body 174 is positioned in close proximity to an inner surface 176*a* of an end wall 176 of reservoir 112 that is positioned proximate to end 119 of housing 110. Shaft 175 extends axially outward away from roll body 174 through end wall 176 and toward end 119 of housing 110. A portion of shaft 175 outside of toner reservoir 112 and outboard of end wall 176 is received by a bearing 177 that rotatably supports shaft 175. A gear 178 is coupled to a portion of shaft 175 outboard of bearing 177 for receiving rotational motion indirectly from drive coupler 140 to rotate toner adder roll 130. In the example embodiment illustrated, a seal 179 positioned between bearing 177 and an outer surface 176*b* of end wall 176 helps prevent toner in reservoir 112 from leaking from toner cartridge 100 or from contaminating bearing 177. In this embodiment, positioning slot 170 is positioned between end wall 176 of reservoir 112 and gear 178 along longitudinal dimension 113, e.g., between end wall 176 and bearing 177 along longitudinal dimension 113 or between end wall 176 and seal 179 along longitudinal dimension 113. Nesting positioning slot 170 in the space between end wall 176 and gear 178 along longitudinal dimension 113 avoids the need to enlarge the size of toner cartridge 100 along longitudinal dimension 113 in order to accommodate positioning slot 170. In this configuration, positioning slot 170 and roll body 174 of toner adder roll 130 are positioned immediately adjacent to and on opposite sides of end wall 176 of reservoir 112 from each other. In the example embodiment illustrated, outer surface 176*b* of end wall 176 also forms wall 171 of positioning slot 170.

While the example embodiment illustrated shows positioning slot 170 formed between a pair of walls 171, 172, in other embodiments, wall 172 may be omitted such that positioning slot 170 is formed on one side by wall 171 and is open on the opposite side to end 119 of housing 110. In this embodiment, wall 171 is recessed along longitudinal dimension 113 of housing 110 from an outer surface of end 119 of housing 110, but is open to end 119 of housing 110.

Figure 10:
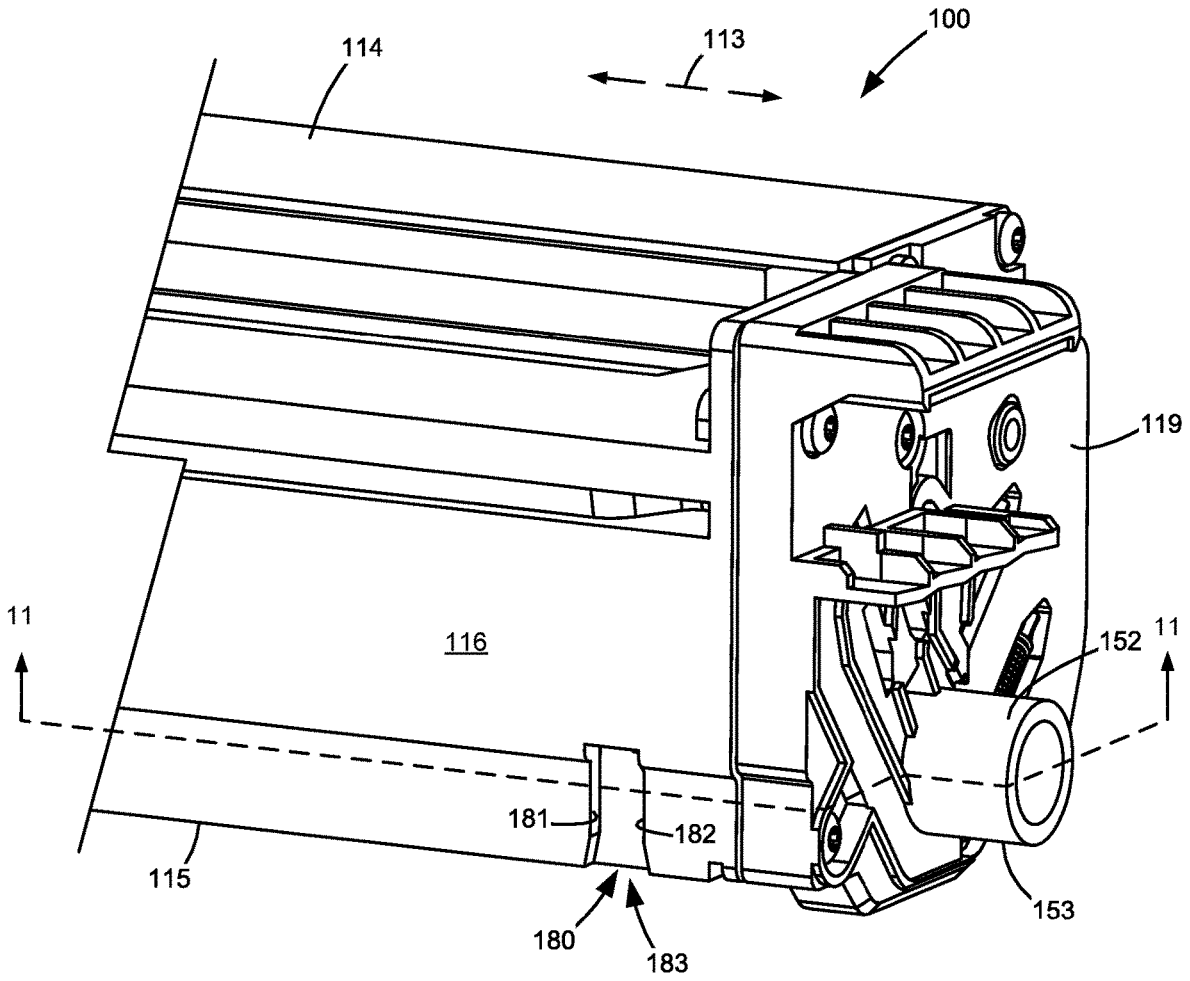
FIG. 10 is a perspective view of the toner cartridge showing a positioning slot on the developer unit of the toner cartridge according to one example embodiment.

With reference to FIGS. 4 and 10, toner cartridge 100 also includes a positioning slot 180 that receives a corresponding positioning rib in image forming device 22 to define a position of photoconductor unit 104 along longitudinal dimension 113 of housing 110 (i.e., along axial dimensions of photoconductive drum 120, developer roll 128 and toner adder roll 130). Positioning slot 180 is positioned on side 116 of housing 110, near end 119 of housing 110. In the embodiment illustrated, positioning slot 180 extends upward (e.g, vertically upward) from bottom 115 of housing 110 at side 116. In this embodiment, positioning slot 180 is formed between a first wall 181 that faces away from end 118 and toward end 119 and a second wall 182 that faces away from end 119 and toward end 118. In some embodiments, walls 181 and 182 are parallel to each other, but, in other embodiments, they are not. In the embodiment illustrated, positioning slot 180 includes an open bottom end 183 that permits the corresponding positioning rib in image forming device 22 to enter positioning slot 180 between walls 181, 182 from below upon installation of toner cartridge 100 in image forming device 22 as discussed in greater detail below. In this embodiment, positioning slot 180 is recessed into side 116 of housing 110. The width of positioning slot 180 as measured from wall 181 to wall 182 may be constant or it may vary, e.g., positioning slot 180 may include a tapered lead-in at bottom end 183 causing the width of positioning slot 180 to narrow as positioning slot 180 extends upward from bottom end 183. In the example embodiment illustrated, positioning slot 180 overlaps along longitudinal dimension 113 of housing 110 with positioning slot 170.

Figure 11:
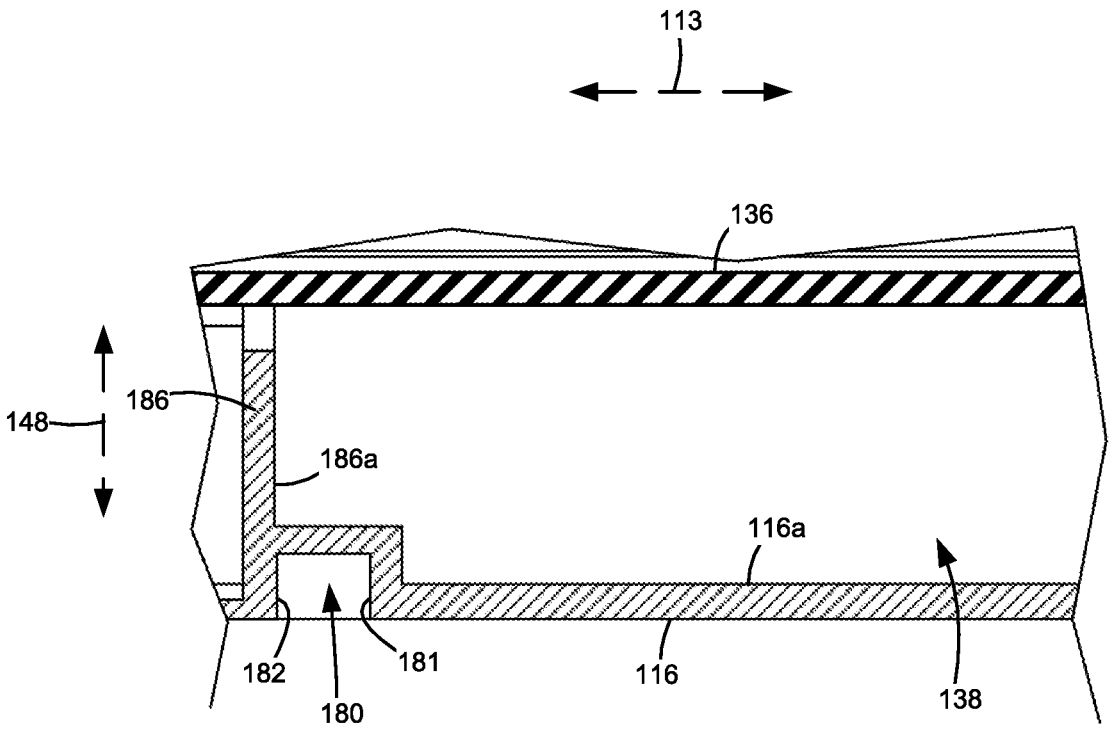
FIG. 11 is a cross-sectional view of the toner cartridge taken along line 11-11 in FIG. 10 showing the positioning slot on the developer unit of the toner cartridge.

FIG. 11 is a cross-sectional view showing the position of positioning slot 180 on toner cartridge 100 relative to internal components of photoconductor unit 104 in greater detail according to one example embodiment. In this embodiment, photoconductor unit 104 includes waste toner reservoir 138 which stores residual toner removed from the surface of photoconductive drum 120 by cleaner blade 136. In the example embodiment illustrated, waste toner reservoir 138 extends along an inner surface 116*a* of side 116 of housing 110. An end wall 186 of waste toner reservoir 138 is positioned near end 119 of housing 110. In the example embodiment illustrated, positioning slot 180 is positioned at the intersection of end wall 186 and side 116 of housing 110 such that wall 182 of positioning slot 180 is formed by an inner surface 186*a* of end wall 186 of waste toner reservoir 138. This configuration helps minimize the intrusion into waste toner reservoir 138 by positioning slot 180 in order to help maximize the available volume for waste toner in waste toner reservoir 138.

Figure 12:
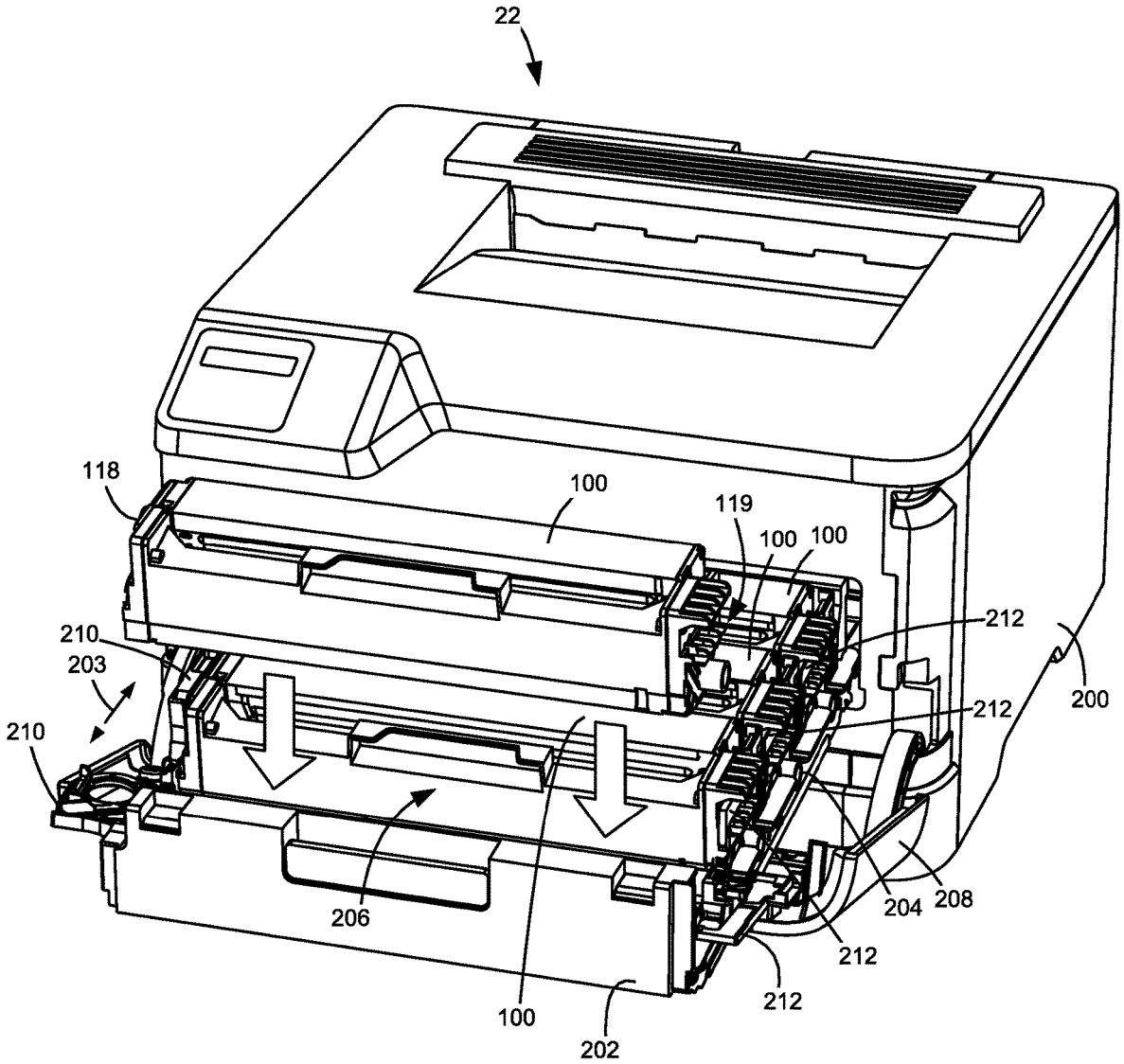
FIG. 12 is a perspective view of the image forming device showing a drawer having a basket for holding four toner cartridges according to one example embodiment.

FIG. 12 shows image forming device 22 according to one example embodiment. In this embodiment, image forming device 22 includes a housing 200 and a drawer 202 mounted on housing 200. Drawer 202 is slidable into and out of housing 200 along a sliding direction 203 between an open position (shown in FIG. 12) and a closed position. Drawer 202 includes a basket 204 configured to receive and support four toner cartridges 100 in image forming device 22. In this embodiment, each of the four toner cartridges 100 is substantially the same except for the color of the toner contained therein. Toner cartridges 100 are vertically insertable into and removable from four corresponding positioning slots 206 of basket 204. Positioning slots 206 of basket 204 locate toner cartridges 100 in their operating positions within image forming device 22 when toner cartridges 100 are installed in basket 204 and drawer 202 is closed. In the embodiment illustrated, drawer 202 is accessible through an access door 208 of image forming device 22.

In the example embodiment illustrated, each positioning slot 206 includes a pair of corresponding latches 210, 212 that secure a respective toner cartridge 100 in basket 204. One latch 210 is positioned at a first end of the positioning slot 206 proximate to a first end 118 of the corresponding toner cartridge 100 and the other latch 212 is positioned at an opposite end of the positioning slot 206 proximate to the opposite end 119 of the corresponding toner cartridge 100. FIG. 12 shows a first toner cartridge 100 removed from its corresponding positioning slot 206 in basket 204 and a pair of corresponding latches 210, 212 in unlatched positions. FIG. 12 shows the other three toner cartridges 100 of image forming device 22 installed in their corresponding positioning slots 206 in basket 204 and their corresponding latches 210, 212 in latched positions securing the three toner cartridges 100 in basket 204. In the example embodiment illustrated, each latch 210, 212 is manually movable between a latched position and an unlatched position permitting a user to selectively secure a particular toner cartridge 100 to basket 204 or remove a particular toner cartridge 100 from basket 204. In this embodiment, latches 210, 212 are pivotable between their latched and unlatched positions about respective pivot axes that run along sliding direction 203 of drawer 202; however, latches 210, 212 may move in other manners as desired.

Figure 13:
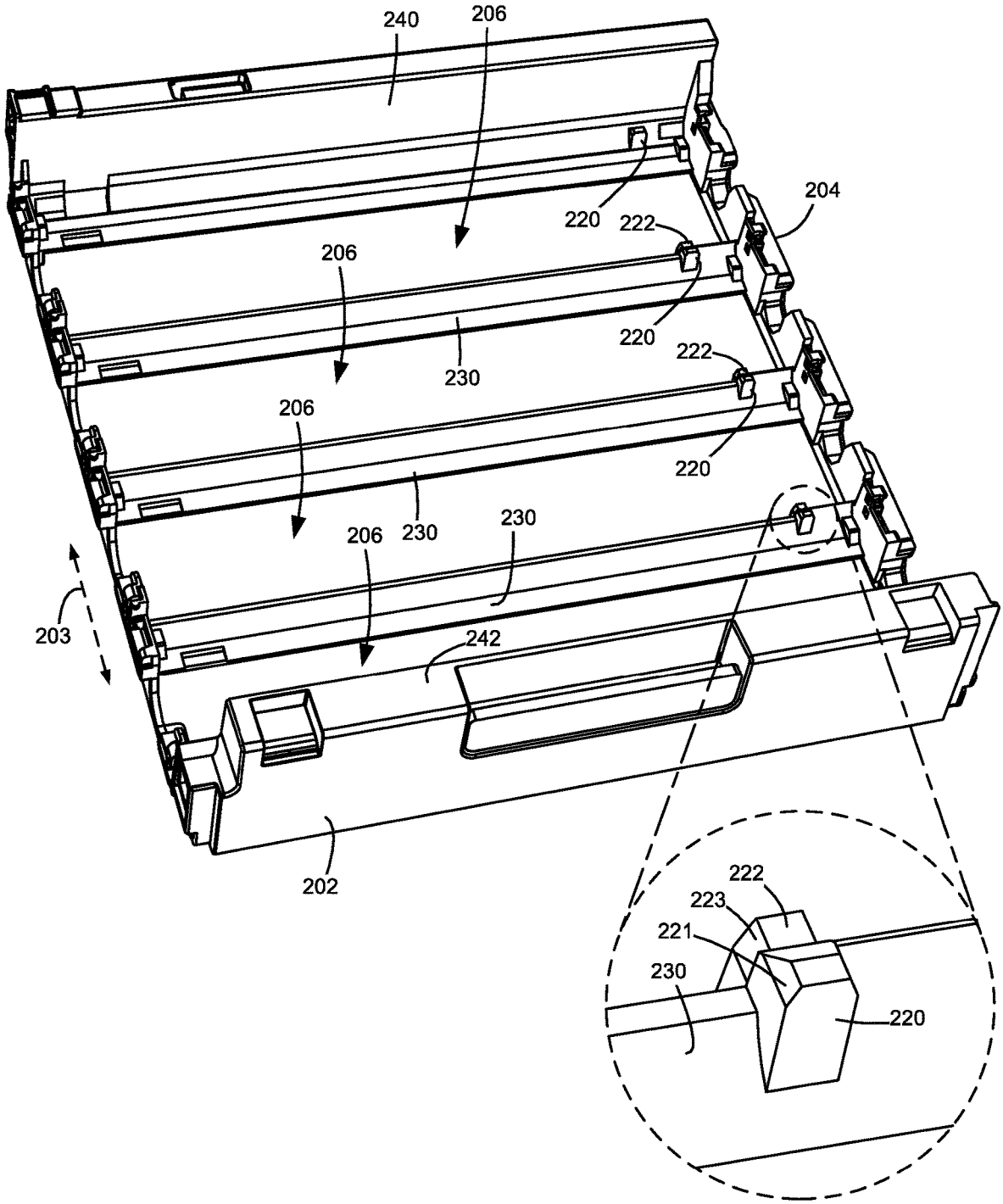
FIG. 13 is a perspective view of the basket shown in FIG. 12 with no toner cartridges installed therein showing positioning ribs of the basket according to one example embodiment.

FIG. 13 shows drawer 202 including basket 204 removed from image forming device 22 with all toner cartridges 100 removed according to one example embodiment. FIG. 13 shows four positioning slots 206 configured to receive the four corresponding toner cartridges 100 of image forming device 22. Each positioning slot 206 includes a pair of positioning ribs 220, 222 on opposite sides of the positioning slot 206. Positioning ribs 220, 222 are positioned to enter the positioning slots 170, 180 of the corresponding toner cartridge 100 when the toner cartridge 100 is installed in a positioning slot 206 of basket 204. In the example embodiment illustrated, basket 204 includes three parallel rails 230 that extend perpendicular to sliding direction 203 of drawer 202, parallel to longitudinal dimension 113 of toner cartridges 100. Rails 230 separate the positioning slots 206 of basket 204 from each other and provide additional rigidity to basket 204. In this embodiment, the positioning ribs 220, 222 of adjacent positioning slots 206 are formed as adjacent projections from a common rail 230 as shown in the enlarged portion of FIG. 13 (whereas the positioning rib 220 of the topmost positioning slot 206 as viewed in FIG. 13 is positioned on a first end wall 240 of basket 204 and the positioning rib 222 of the bottommost positioning slot 206 as viewed in FIG. 13 is positioned on a second end wall 242 of basket 204). Specifically, the positioning rib 220 that engages a positioning slot 170 on the developer unit 102 of one toner cartridge 100 is formed on the same rail 230 as the positioning rib 222 that engages a positioning slot 180 on the photoconductor unit 104 of an adjacent toner cartridge 100. This configuration provides improves the rigidity of positioning ribs 220, 222 formed on rails 230.

Figure 14:
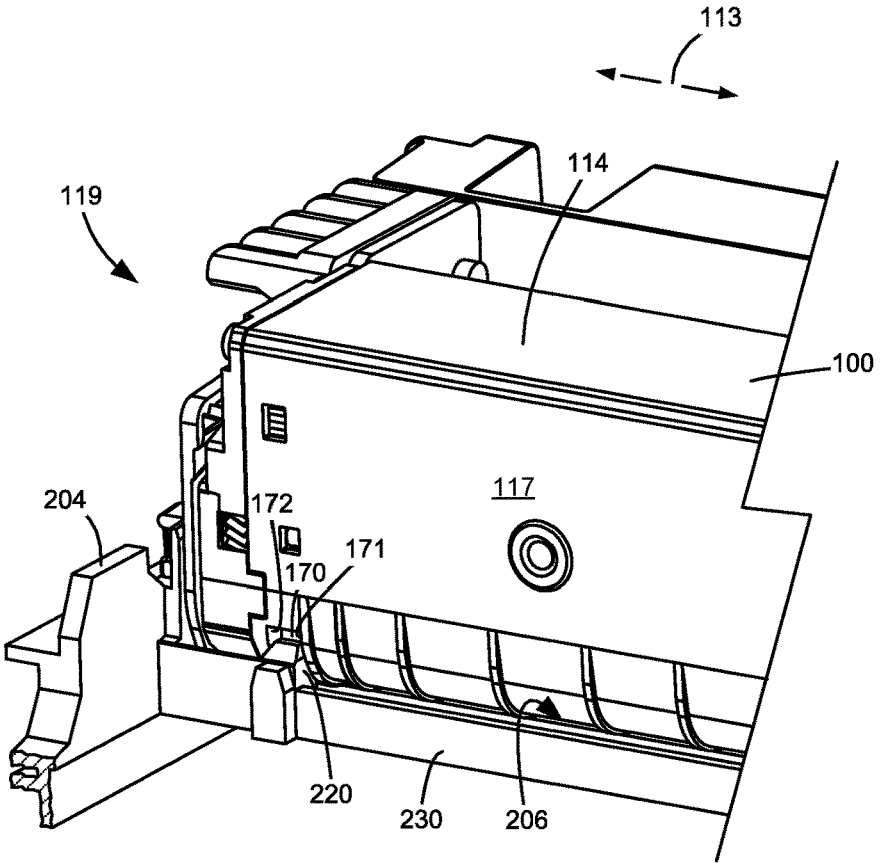
FIG. 14 is a perspective view showing the engagement between the positioning slot on the photoconductor unit of the toner cartridge with a corresponding positioning rib of the basket when the toner cartridge is installed in the basket according to one example embodiment.
Figure 15:
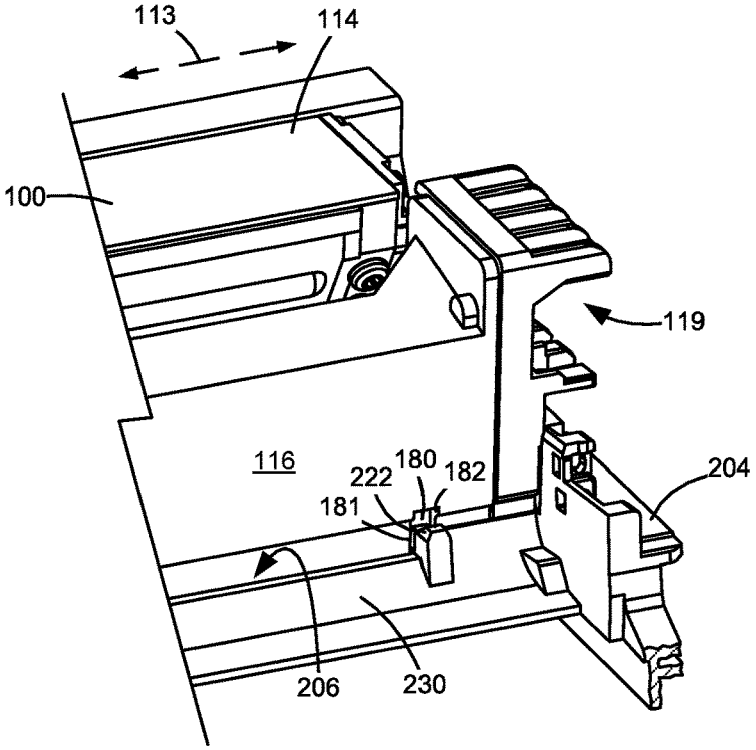
FIG. 15 is a perspective view showing the engagement between the positioning slot on the developer unit of the toner cartridge with a corresponding positioning rib of the basket when the toner cartridge is installed in the basket according to one example embodiment.

FIGS. 14 and 15 show the engagement between positioning slots 170, 180 of toner cartridge 100 and positioning ribs 220, 222 of a corresponding positioning slot 206 when toner cartridge 100 is installed in basket 204. As a user lowers toner cartridge 100 into its corresponding positioning slot 206 in basket 204, contact between longitudinal ends 118, 119 of housing 110 and corresponding longitudinal ends of positioning slot 206 tends to provide coarse alignment of toner cartridge 100 to basket 204 along longitudinal dimension 113 of housing 110 during installation of toner cartridge 100 into basket 204. As toner cartridge 100 reaches its final position in positioning slot 206, positioning ribs 220, 222 of basket 204 enter corresponding positioning slots 170, 180 of toner cartridge 100. Positioning ribs 220, 22.2 may include tapered top portions 221, 223 (FIG. 13) to help facilitate entry of positioning ribs 220, 222 into positioning slots 170, 180. Contact between positioning ribs 220, 222 and walls 171, 172, 181, 182 of positioning slots 170, 180 provides precise alignment of toner cartridge 100 to basket 204 along longitudinal dimension 113 of housing 110. In the example embodiment illustrated, during operation, the force on drive coupler 140 from the corresponding drive coupler in image forming device 22 tends to apply a force along longitudinal dimension 113 of housing 110 in a direction from end 118 toward end 119, which tends to force positioning rib 220 into contact with wall 171 of positioning slot 170 in this embodiment.

The engagement between positioning slots 170, 180 of toner cartridge 100 and corresponding positioning ribs 220, 222 of basket 204 provides independent positioning of developer unit 102 and photoconductor unit 104 along longitudinal dimension 113 of housing 110. Independently locating developer unit 102 and photoconductor unit 104 to basket 204 helps minimize the tolerance stack up between developer unit 102 and photoconductor unit 104 and basket 204 (and, in turn, between developer unit 102 and photoconductor unit 104 and the frame of image forming device 22) along longitudinal dimension 113 of housing 110 (i.e., along axial dimensions of photoconductive drum 120, developer roll 128 and toner adder roll 130). Minimizing the tolerance stack up along longitudinal dimension 113 permits the use of shorter imaging components in toner cartridge 100, such as developer roll 128 and photoconductive drum 120, and a shorter overall toner cartridge 100 along longitudinal dimension 113 which, in turn, permits a smaller footprint for image forming device 22 in accordance with consumer preferences for more compact devices and components.

Although the example embodiment discussed above includes a single replaceable unit in the form of toner cartridge 100 for each toner color, it will be appreciated that the replaceable unit(s) of the image forming device may employ any suitable configuration as desired. For example, in one embodiment, the main toner supply for the image forming device is provided in a first replaceable unit and the developer unit and photoconductor unit are provided in a second replaceable unit. In another embodiment, the main toner supply for the image forming device and the developer unit are provided in a first replaceable unit and the photoconductor unit is provided in a second replaceable unit. Other configurations may be used as desired.

Further, it will be appreciated that the architecture and shape of toner cartridge 100 illustrated in FIGS. 2-5 is merely intended to serve as an example. Those skilled in the art understand that toner cartridges, and other toner containers, may take many different shapes and configurations.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge, comprising:

a housing having a top, a bottom, a first side and a second side positioned between a first longitudinal end and a second longitudinal end of the housing, the housing has a reservoir for holding toner;

a photoconductive drum rotatable relative to the housing, a portion of an outer surface of the photoconductive drum is positioned along the bottom of the housing, the photoconductive drum includes a rotational axis that extends in a direction from the first longitudinal end to the second longitudinal end;

a developer roll rotatable relative to the housing and positioned to supply toner from the reservoir to the photoconductive drum;

a first drive coupler and a second drive coupler on the first longitudinal end of the housing for mating with a first corresponding drive coupler in an image forming device and a second corresponding drive coupler in the image forming device for receiving rotational motion from the first corresponding drive coupler in the image forming device and the second corresponding drive coupler in the image forming device when the toner cartridge is installed in the image forming device, the first drive coupler of the toner cartridge is operatively connected to the photoconductive drum to transfer rotational motion to the photoconductive drum and the second drive coupler of the toner cartridge is operatively connected to the developer roll to transfer rotational motion to the developer roll;

a first positioning slot on the first side of the housing for receiving a first corresponding positioning rib in the image forming device for defining an axial position of the photoconductive drum relative to the image forming device along the first rotational axis when the toner cartridge is installed in the image forming device, the first positioning slot extends upward from the bottom of the housing near the second longitudinal end of the housing; and a second positioning slot on the second side of the housing for receiving a second corresponding positioning rib in the image forming device for defining an axial position of the developer roll relative to the image forming device when the toner cartridge is installed in the image forming device, the second positioning slot extends upward from the bottom of the housing near the second longitudinal end of the housing, wherein the first positioning slot is formed between a first upward extending wall and a second upward extending wall and the second positioning slot is formed between a third upward extending wall and a fourth upward extending wall, the first and third upward extending walls face away from the first longitudinal end of the housing and toward the second longitudinal end of the housing and the second and fourth upward extending walls face away from the second longitudinal end of the housing and toward the first longitudinal end of the housing, wherein the first positioning slot and the second positioning slot each include an open bottom end that permits the respective first and second corresponding positioning ribs in the image forming device to enter the first and second positioning slots from below when the toner cartridge is installed in the image forming device.

2. The toner cartridge of claim 1, wherein the first positioning slot overlaps with the second positioning slot along a longitudinal dimension of the housing that runs from the first longitudinal end to the second longitudinal end.

3. The toner cartridge of claim 1, wherein the first positioning slot is recessed into an exterior of the first side of the housing and the second positioning slot is recessed into an exterior of the second side of the housing.

4. The toner cartridge of claim 1, further comprising:

a toner adder roll rotatably positioned on the housing to supply toner from the reservoir to the developer roll, the toner adder roll includes a roll body cylindrically disposed around a shaft, the roll body extends along an inner surface of the bottom of the housing and an inner surface of the second side of the housing, an axial end of the roll body is positioned adjacent to an inner surface of an end wall of the reservoir that is proximate the second longitudinal end of the housing, the shaft extends through an opening in the end wall of the reservoir toward the second longitudinal end of the housing; and a gear positioned on the shaft of the toner adder roll outboard of the end wall of the reservoir, wherein the second positioning slot is positioned between the end wall of the reservoir and the gear along a longitudinal dimension of the housing that runs from the first longitudinal end to the second longitudinal end.

5. The toner cartridge of claim 4, wherein the second positioning slot and the roll body of the toner adder roll are positioned immediately adjacent to and on opposite sides of the end wall of the reservoir from each other.

6. The toner cartridge of claim 1, further comprising a waste toner reservoir positioned to store residual toner removed from the outer surface of the photoconductive drum, wherein the first positioning slot is positioned at an intersection of the first side of the housing and an end wall of the waste toner reservoir that is proximate to the second longitudinal end of the housing.

7. A toner cartridge, comprising:

a housing having a top, a bottom, a first side and a second side positioned between a first longitudinal end and a second longitudinal end of the housing, the housing has a reservoir for holding toner, a longitudinal dimension of the housing runs from the first longitudinal end to the second longitudinal end;

a photoconductor unit positioned along the first side of the housing and having a rotatable photoconductive drum, a portion of an outer surface of the photoconductive drum is positioned along the bottom of the housing, the photoconductive drum includes a rotational axis that runs from the first longitudinal end to the second longitudinal end;

a developer unit positioned along the second side of the housing and having a rotatable developer roll, the developer roll is positioned to supply toner from the reservoir to the photoconductive drum;

a first drive coupler and a second drive coupler on the first longitudinal end of the housing for mating with a first corresponding drive coupler in an image forming device and a second corresponding drive coupler in the image forming device for receiving rotational motion from the first corresponding drive coupler in the image forming device and the second corresponding drive coupler in the image forming device when the toner cartridge is installed in the image forming device, the first drive coupler of the toner cartridge is operatively connected to the photoconductive drum to transfer rotational motion to the photoconductive drum and the second drive coupler of the toner cartridge is operatively connected to the developer roll to transfer rotational motion to the developer roll;

a first positioning slot on the first side of the housing and on the photoconductor unit, the first positioning slot is configured to receive a first corresponding positioning rib in the image forming device for defining a position of the photoconductor unit relative to the image forming device along the longitudinal dimension of the housing when the toner cartridge is installed in the image forming device, the first positioning slot extends upward from the bottom of the housing near the second longitudinal end of the housing; and a second positioning slot on the second side of the housing and on the developer unit, the second positioning slot is configured to receive a second corresponding positioning rib in the image forming device for defining a position of the developer unit relative to the image forming device along the longitudinal dimension of the housing when the toner cartridge is installed in the image forming device, the second positioning slot extends upward from the bottom of the housing near the second longitudinal end of the housing.

8. The toner cartridge of claim 7, wherein the first positioning slot overlaps with the second positioning slot along the longitudinal dimension of the housing.

9. The toner cartridge of claim 7, wherein the first positioning slot is formed between a first upward extending wall and a second upward extending wall and the second positioning slot is formed between a third upward extending wall and a fourth upward extending wall, the first and third upward extending walls face away from the first longitudinal end of the housing and toward the second longitudinal end of the housing and the second and fourth upward extending walls face away from the second longitudinal end of the housing and toward the first longitudinal end of the housing.

10. The toner cartridge of claim 7, wherein the first positioning slot and the second positioning slot each include an open bottom end that permits the respective first and second corresponding positioning ribs in the image forming device to enter the first and second positioning slots from below when the toner cartridge is installed in the image forming device.

11. The toner cartridge of claim 7, wherein the first positioning slot is recessed into an exterior of the first side of the housing and the second positioning slot is recessed into an exterior of the second side of the housing.

12. The toner cartridge of claim 7, wherein the developer unit includes a rotatable toner adder roll positioned to supply toner from the reservoir to the developer roll, the toner adder roll includes a roll body cylindrically disposed around a shaft, the roll body extends along an inner surface of the bottom of the housing and an inner surface of the second side of the housing, an axial end of the roll body is positioned adjacent to an inner surface of an end wall of the reservoir that is proximate the second longitudinal end of the housing, the shaft extends through an opening in the end wall of the reservoir toward the second longitudinal end of the housing, a gear is positioned on the shaft of the toner adder roll outboard of the end wall of the reservoir, wherein the second positioning slot is positioned between the end wall of the reservoir and the gear along the longitudinal dimension of the housing.

13. The toner cartridge of claim 12, wherein the second positioning slot and the roll body of the toner adder roll are positioned immediately adjacent to and on opposite sides of the end wall of the reservoir from each other.

14. The toner cartridge of claim 7, wherein the photoconductor unit includes a waste toner reservoir positioned to store residual toner removed from the outer surface of the photoconductive drum, wherein the first positioning slot is positioned at an intersection of the first side of the housing and an end wall of the waste toner reservoir that is proximate to the second longitudinal end of the housing.

* * * * *